United States Patent [19]

Hinze et al.

[11] 4,239,950

[45] Dec. 16, 1980

[54] PUSHBUTTON SWITCH

[75] Inventors: Klaus Hinze; Klaus B. Wisskirchen, both of Berlin, Fed. Rep. of Germany

[73] Assignee: ITT Industries, Inc., New York, N.Y.

[21] Appl. No.: 15,951

[22] Filed: Feb. 28, 1979

[51] Int. Cl.[3] ..... H01H 15/09; H01H 15/06; H01H 15/22; H01H 1/42

[52] U.S. Cl. ..... 200/254; 200/16 F; 200/284

[58] Field of Search ..... 200/16 F, 254, 284, 200/159 R; 339/119 R, 278 T

[56] References Cited

U.S. PATENT DOCUMENTS

| | | | |
|---|---|---|---|
| 1,857,487 | 5/1932 | Wadsworth | 200/254 X |
| 3,801,875 | 4/1974 | Morby et al. | 200/284 X |
| 3,947,391 | 3/1976 | Lutzenberger | 200/16 F X |
| 4,016,377 | 4/1977 | Iwasaki | 200/16 F |
| 4,122,317 | 10/1978 | Shimamune et al. | 200/16 F |

FOREIGN PATENT DOCUMENTS

| | | | |
|---|---|---|---|
| 32100 | 9/1927 | France | 200/254 |
| 1321503 | 2/1963 | France | 200/16 F |

*Primary Examiner*—Stephen Marcus
*Attorney, Agent, or Firm*—James B. Raden; William J. Michals

[57] ABSTRACT

A pushbutton switch of the type utilizing contact blades. The blades are the fixed contacts of the switch and consist of a U-shaped contact part and a straight connecting part joined therewith. The connecting part extends through an opening in the base of the U-shaped contact part and projects from opposite sides of the switch housing. Accordingly, the respective parts can be made of different materials and in an inexpensive and simple manner.

3 Claims, 2 Drawing Figures

PUSHBUTTON SWITCH

Figure 1:
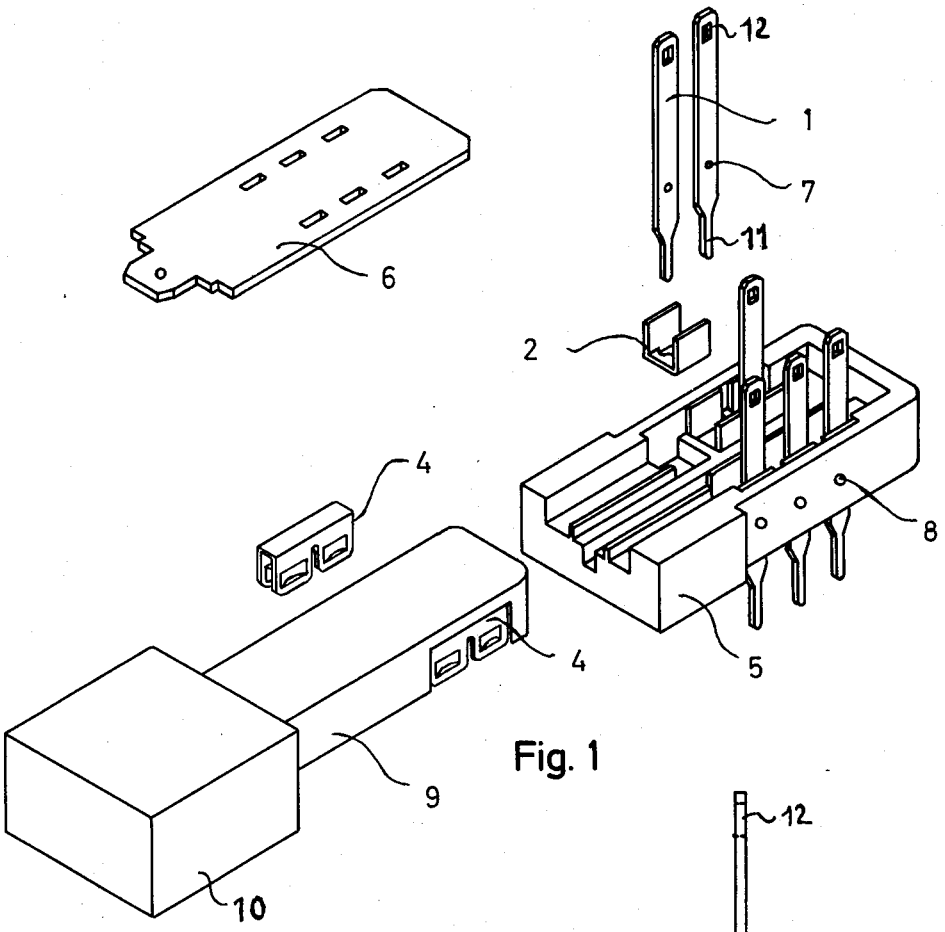

The present invention relates to an electric switch in which at least one contact blade is moved in such a way in relation to at least two oppositely arranged contacts, that in the one switch position the contact blade will come to lie between the oppositely arranged contacts.

Such types of switches are referred to as contact blade switches, because during the switching process, the contact blade engages between two oppositely arranged contacts thus, so to speak, cutting them open. Such contact blades result in a very good and reliable electrical contact, because the contact blade is contacted on both sides, thus providing a large current transfer area. By engaging of the contact blade between the two oppositely arranged contacts, the contacting points are reliably cleaned during each switching process. With regard to manufacture, however, the material investment is relatively high compared to that of simple contacts. Therefore, contact blades only have a restricted range of practical application.

It is the object of the invention to simplify both the construction and the manufacture of the contact blades, to make them more inexpensive and, in addition thereto, to design the construction of the contact blades in such a way that electrical terminals are available on both sides of the switch.

With an electric switch of the type mentioned hereinbefore, this object is achieved in that the contact blade is designed as a stationary contact consisting of a U-shaped contact part and of a straight connecting part joined thereto and protruding on both sides from the switch housing.

In most types of blade contacts, the contact blade is designed as a movable contact part while the two oppositely arranged contacts are designed as stationary contacts. In distinction thereto, the contact blade according to the invention is designed as a stationary contact and the two oppositely arranged contacts form the movable contacts. These oppositely arranged movable contacts can be easily manufactured in that a strip of resilient contact material is bent in a U-shaped manner, with the two legs (limbs) of the U-shaped part forming the two oppositely arranged contacts. If, in addition thereto, the movable contacts are still designed as a contact bridge, it is not necessary to attach an electric terminal to the U-shaped part.

It is far more difficult to design the contact blade, especially when this contact blade is required to have two oppositely arranged terminals. According to the invention, this difficulty is avoided in that the contact blade consists of one U-shaped contact part and of one straight connecting part joined thereto. These two individual parts can be very easily manufactured and joined in a simple way to form a contact blade having terminals. The design consisting of two parts still has the added advantage that the two parts can be made of different materials adapted to the respective function of the individual parts. The U-shaped contact part may be preferably provided with a noble metal coating, which is not necessary with respect to the connecting part. The connecting part, however, will have to be provided with a well solderable coating in order to be able to establish in a simple way an electrical connection towards the outside.

The connecting part is preferably arranged to be applied to one leg of the contact part.

It is particularly simple to provide the U-shaped contact part in its centre with one or more slots positioned near one leg, and into which the contact part is inserted. Providing two slots offers the advantage that during the assembly of the contact part it is not necessary to carry out an orientation according to the slot. The two slots preferably form one single opening which can be easily produced by way of punching in the centre of the contact part.

For establishing a good electrical and mechanical connection it is sufficient for both parts to be designed in such a way that the connecting part can be arranged in a press or snug fit in the slot of the contact part. It is then sufficient during the assembly, to firmly press the oblong connecting part into the slot of the U-shaped contact part. If so required, there may still be carried out a soldering or welding of the two parts to one another. Practice has shown, however, that this is not necessary as a rule.

The contact part is preferably designed at one end as a soldering pin and, at the other end, as a soldering lug. The finished switch will then contain on one side one row of soldering pins and, on the other side, one row of soldering lugs. The soldering pins serve to solder the switch directly into the corresponding holes of a printed circuit board while the soldering lugs serve the soldering of lead-in wires thereto. In some cases it may also be of advantage to provide either soldering pins or soldering lugs at both ends.

A particularly simple construction of the switch will result when the movable contacts are designed as contact bridges comprising at least two pairs of oppositely arranged contacts lying behind each other in the direction of movement.

Contact blades designed in this way can be used with the most various types of switches. Thus, for example, the stationary contacts, that is, the U-shaped contact parts with the connecting parts applied thereto, may be arranged along the circumference of a circle, while the movable contacts designed as contact bridges, may be led with the aid of a rotor over the legs of the U-shaped contact parts forming the contact blade. In this way there is obtained a rotary switch comprising contact blades.

One particularly advantageous type of embodiment of the invention forms a slide switch comprising contact blades, in which the stationary contacts are arranged in at least one row inside a switch housing while the movable contact bridges are arranged on a slide capable of being actuated by a pushbutton.

Both the manufacture and the assembly of such a switch and of the associated contacts can be carried out in a very simple way, and also individual parts can be manufactured easily and inexpensively.

Mounting the stationary contacts inside the switch housing is substantially simplified in that the contact parts are provided with at least one borehole or a recess into which the material of the switch housing is pressed with the aid of a hot die stamp. The assembly of such a switch requires no soldering, welding or screwing processes.

Figure 2:
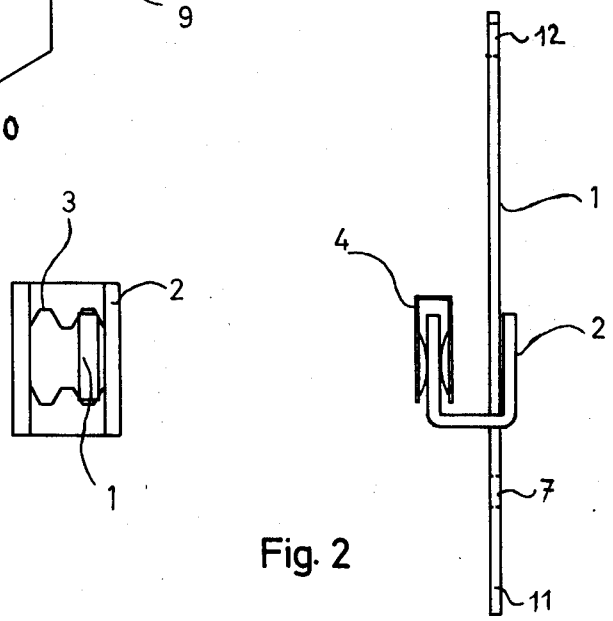

The invention will now be explained in greater detail with reference to a pushbutton-actuated slide switch according to the invention shown in FIGS. 1 and 2 of the accompanying drawings, in which:

FIG. 1 shows the individual parts of a pushbutton-actuated slide switch is a perspective representation, and FIG. 2 shows the parts of the indivual contacts both in a top and side view.

The pushbutton-actuated slide switch as shown in FIG. 1 consists of a switch housing 5 of thermoplastic material having cavities formed therein for receiving the fixed contacts. The switch housing is closed by a cover 6 placed thereon.

Inside the switch housing the slide 9 is permitted to slide, with this slide carrying the movable contacts 4 and being actuated with the aid of a pushbutton 10. Of course, the switch is still provided with corresponding reset springs for the slide, as well as with any possibly required engaging and locking elements which may serve the mutual locking a releasing of several pushbutton-actuated slide switches arranged next to each other. For the sake of clarity, however, these are not shown in the drawing.

The movable contacts 4 are formed by a U-shaped contact bridge containing two pairs of oppositely arranged contacts, as is recognizable from FIG. 1.

The stationary contacts consist of a contact part 2 and of a connecting part 1 which are connected to one another mechanically and electrically. The connecting parts are preferably provided at one end with a soldering pin 11 and, at the other end, with a soldering lug 12. The U-shaped contact part 2 preferably consists of brass coated with noble metal, such as with silver or gold. The connecting part may consist of a more inexpensive material, if necessary, of galvanized or tin-coated iron sheet metal. It is already recognizable from FIG. 1, that the two parts 1 and 2 have a very simple shaped and can be easily manufactured by employing a simple punching and bending process. The U-shaped contact part 2 is provided in its centre with an opening 3 which is shown in FIG. 2. This opening includes two slots applied to the legs of the U-shaped part. In one of these slots there is inserted the straight contact part in such a way as to establish a good electrical contact with the U-shaped contact part. As a rule, it is sufficient to firmly press the connecting part into the slot 3, because it is relatively soft owing to the solderable coating on the contact part 11, thus safeguarding a good electrical connection between the two parts.

During the assembly, the U-shaped contact parts 2 are inserted in the switch housing 5, and the oblong connecting parts 1 are firmly inserted in the one slot of the contact part 2.

The fixing in position of the two parts connected to one another inside the switch housing 5, is effected by a positive connection with the material of the switch housing. For this purpose the connecting parts are provided with holes 7 into which there is pressed the material of the switch housing 5. This is done with the aid of heated die punches which, opposite the hole 7 are pressed into the switch housing from the outside. From this there will then result the impressions of the switch housing indicated by the reference numeral 8. The material of the housing 5 impressed at the points indicated by the reference numeral 8, enters into the holes 7 of the connecting parts, thus forming a positive connection with the material. Thereafter, the slide 9 with the inserted contact bridges 4 is slipped into the housing, and the latter is closed by positioning the cover 6 thereon.

FIG. 2 shows how the connecting part 1 is inserted in the opening 3 of the contact part 2, and how it extends by being applied to one leg of the contact part 2. Likewise, it can be seen how the other leg of the contact part slides between the oppositely arranged contacts of the contact bridge 4.

What is claimed is:

1. A pushbutton switch comprising, in combination:

a longitudinally extending housing having at least a pair of cavities therein for receiving fixed contacts;

a slider movably mounted in said housing and in the longitudinal direction of said housing;

a pair of longitudinally spaced U-shaped fixed contacts respectively fixedly mounted in said cavities, each of said U-shaped fixed contacts having a base portion engaging the bottom of the respective cavity and having at least one slot in said base portion for receiving a blade contact therein;

a U-shaped movable contact mounted to said slider for receiving and conductively engaging one leg of said U-shaped fixed contacts between the pair of legs of said U-shaped movable contact; and, a pair of blade contacts respectively extending through and conductively engaging said slot of said U-shaped contacts and extending beyond the housing in opposite directions.

2. The switch according to claim 1, wherein each of said U-shaped fixed contacts includes a pair of slots each of said slots being adjacent to one leg of said U-shaped fixed contacts so that the respective one of said blade contacts may extend through either one of said slots of said pair of slots.

3. The switch according to claim 2, wherein the material of said blades is different than the material of said fixed contacts.

* * * * *